US005221195A

United States Patent [19]

Beelen

[11] Patent Number: 5,221,195

[45] Date of Patent: Jun. 22, 1993

[54] PRESSURE TESTING PUMP

[75] Inventor: Valére H. J. Beelen, Sint-Truiden, Belgium

[73] Assignee: Emerson Electric Co., St. Louis, Mo.

[21] Appl. No.: 859,653

[22] Filed: Mar. 30, 1992

[51] Int. Cl.[5] ..... F04B 19/02

[52] U.S. Cl. ..... 417/461; 417/464

[58] Field of Search ..... 417/461, 464

[56] References Cited

U.S. PATENT DOCUMENTS

| | | | |
|---|---|---|---|
| 32,251 | 5/1861 | May | 417/464 |
| 1,405,908 | 2/1922 | Edwards | 417/464 X |
| 2,781,166 | 2/1957 | Flood et al. | 230/175 |
| 2,884,803 | 5/1959 | Willis | 74/512 |
| 2,910,875 | 11/1959 | Kuhnhausen | 417/464 |
| 3,263,515 | 8/1966 | Adamski | 74/105 |
| 3,788,161 | 1/1974 | Krusemark | 74/516 |
| 3,911,760 | 10/1975 | Elbers et al. | 74/512 |
| 4,289,458 | 9/1981 | Price | 417/464 |
| 4,323,009 | 4/1982 | Voigt | 100/240 |
| 4,385,528 | 5/1983 | Pauwels | 74/516 |
| 4,386,537 | 6/1983 | Lewis | 74/412 |
| 4,671,746 | 6/1987 | Sessody | 417/437 |

FOREIGN PATENT DOCUMENTS

| | | | |
|---|---|---|---|
| 0804526 | 4/1951 | Fed. Rep. of Germany | 417/464 |
| 0510586 | 4/1976 | U.S.S.R. | 417/464 |

OTHER PUBLICATIONS

Ridge Tool Company catalog sheet "Model 1425 Pressure Testing Pump", Apr. 1991.

Ridge Tool Company "1425 Pressure Testing Pump Operator's Manual", 3 pages, Jan. 1991.

*Primary Examiner*—Richard A. Bertsch
*Assistant Examiner*—Alfred Basichas
*Attorney, Agent, or Firm*—Body, Vickers & Daniels

[57] ABSTRACT

A hand lever actuated pump for testing a water line for leaks by pumping water into the line under pressure comprises a container for water to be pumped and a hand lever actuated piston and cylinder type pump having suction and discharge strokes in response to displacement of the hand lever in opposite directions about a lever axis. The piston and cylinder components of the pump are pivotally supported on the container and interconnected with the hand lever so as to provide a high flow rate during the initial part of the discharge stroke and a progressively increasing leverage for displacing the piston during the discharge stroke to provide high pressure discharge at the end of the discharge stroke with a low force application to the hand lever.

29 Claims, 6 Drawing Sheets

PRESSURE TESTING PUMP

BACKGROUND OF THE INVENTION

This invention relates to the art of pumps and, more particularly, to manually operated pumps for testing fluid lines under pressure for leaks.

It is of course well known to test lines in a fluid system such as a hydraulic or water supply system for leaks following installation of the system or the repair of lines therein. The use of manually operated lever type fluid pumps for such testing is likewise well known. Such pumps generally include a container for fluid to be pumped into the system to be tested, and a hand lever actuated piston and cylinder type pump having suction and discharge strokes in response to displacement of the operating lever in opposite directions about a lever axis. The inlet side of the pump is in flow communication with fluid in the container, and the discharge side of the pump is provided with a hose or the like which is adapted to be coupled with the system for delivering fluid thereto from the pump. The system to be tested is initially filled with fluid, and the lever is then displaced in opposite directions about its pivot axis to pump additional fluid into the system until the desired test pressure is attained which may, for example, be 50 bar or 725 psi. Generally, the pump includes a pressure gauge for indicating the system pressure and for determining the presence or absence of leaks in that the system pressure should not fall during the test period if there are no leaks.

In pressure testing pumps of the foregoing character heretofore available the hand lever is pivotally mounted on the container at one end thereof and extends to the opposite end of the container, the pump cylinder is fixed relative to the container, and the piston rod of the pump piston is pivotally attached to the hand lever at a location spaced from the pivot axis for the lever. Pulling up on the hand lever displaces the piston in the cylinder to provide the suction stroke, and pushing down on the hand lever displaces the piston to provide the discharge stroke. The location of the pivot axis for the piston rod relative to the pivot axis for the lever, the size of the piston and the length of the hand lever are variables which cooperatively determine the per stroke volume displacement capability for the pump and the leverage available for displacing the piston during the discharge stroke. High volume flow is desired to minimize the number of strokes and thus the work required by the operator in using the test pump, and good leverage is desired during the discharge stroke, and especially as the test pressure is approached, to enable attaining a high test pressure and to minimize the physical force required to be applied to the lever by the operator as the system pressure increases.

For a given size piston in the pumps heretofore available, initial pumping of additional fluid into the system can be achieved with a full stroke displacement of the hand lever which may, for example, be an angular displacement of about 80° to 90° or more about the lever axis. As the test pressure is approached, however, it is necessary because of the location of the pivot axis for the piston rod relative to the lever axis to limit the stroke of the hand lever to less than about 30° in order for the operator to physically displace the hand lever to displace the piston and thus fluid into the system at or near the test pressure. At lever angle greater than about 30°, it is either impossible for the average operator to apply sufficient force to displace the piston, or it is impossible to move the piston because of the side thrust imposed thereon by the lever-piston rod relationship. Even with a short stroke of 30° or less, the test pumps heretofore available require a force on the hand lever of from about 100 pounds to 140 pounds to achieve piston displacement at a test pressure of 50 bar or 725 psi. Thus, operation of the pump as the test pressure is approached is both difficult and requires undesirably high physical exertion by the operator If the piston rod connection is moved closer to the lever axis and/or the diameter of the piston is reduced, either or both of which will increase the available leverage, the volume displacement capability is reduced, whereby more strokes are required to attain the test pressure and, thus, more time is required to test a system with very little if any reduction in the overall physical exertion required of the operator. In order to optimize the available leverage, the operating end of the hand lever extends beyond the corresponding end of the container for the liquid. While this increase the leverage, such a lever extension is potentially hazardous. In this respect, as the system pressure increases and a greater force application to the end of the lever is required to discharge fluid from the pump, the downward force applied to the end of the lever at a point beyond the end of the container can cause the container to tilt about the latter end thereof. Such instability can cause liquid to spill from the container, subjects the operator to potential injury, and subjects the component parts of the pump to potential damage.

SUMMARY OF THE INVENTION

In accordance with the present invention, a pressure testing pump is provided by which the foregoing and other disadvantages of such pumps heretofore available are minimized or overcome. More particularly in this respect, a pressure testing pump according to the present invention provides a progressively increasing leverage for displacement of the pump piston during the discharge stroke so as to optimize the leverage and considerably reduce the lever force heretofore required to displace the piston during the discharge stroke, especially as the test pressure is approached and finally reached. At the same time, a pump according to the invention achieves the latter advantage without sacrificing the per stroke volume displacement capability of the pump. Moreover, a pressure testing pump in accordance with the present invention enables the pump piston to be displaced by the lever during the discharge stroke, at a test pressure of 50 bar or 725 psi, with an angular displacement of the lever considerably greater than heretofore possible and, at the same time, through the use of a force on the lever substantially less than heretofore required to displace the lever through an angle of 30° or less at the same test pressure.

Preferably, the variable leverage by which the foregoing advantages are realized is achieved through a relatively pivotal interrelationship with respect to the mounting of the piston and cylinder pump and operating lever on the container for the fluid to be pumped. More particularly in this respect, the cylinder of the piston and cylinder pump is supported for pivotal displacement relative to the container, and the lever is pivotally mounted on the container and pivotally interconnected with the piston rod of the pump piston in a manner whereby displacement of the lever in opposite directions about its pivot axis reciprocates the piston in opposite directions in the cylinder to provide the suction and discharge strokes thereof and simultaneously pivots the piston and cylinder unit about the cylinder pivot axis. At the end of the discharge stroke the pivot axis between the lever and piston rod is generally coplanar with the lever axis and cylinder pivot axis and, during the suction stroke, the axis between the piston rod and lever pivots about the pivot axis for the cylinder and away from the lever axis. Accordingly, during the ensuing discharge stroke the pivot axis between the piston rod and lever moves back toward the lever axis and the coplanar relationship with the latter axis and the cylinder pivot axis. This displacement of the piston rod axis progressively increases the leverage on the pump piston during the discharge stroke. The pivotal interrelationship between the piston and cylinder pump and the lever advantageously enables the discharge of fluid from the cylinder at a high test pressure through a larger angular displacement of the lever than heretofore possible and, at the same time with less force on the lever than heretofore required with respect to the same test pressure. These advantages are due in part to the fact that the pivotal relationship referred to minimizes the application of side thrust between the piston rod and cylinder and thus between the piston and cylinder during the discharge stroke, thus enhancing the ease with which the piston can be displaced by the lever. It will be appreciated of course that the volume of fluid displaced also varies during the discharge stroke and progressively decreases from a high volume displacement at the beginning of the discharge stroke to a smaller volume as the lever approaches the end of the discharge stroke. However, the overall volume of fluid displaced during the full discharge stroke is comparable to that of the test pumps heretofore available, and the larger angular displacement capability of the lever at a high test pressure compensates for the progressively decreasing volume of flow and enables a volume of flow as the test pressure is approached which is comparable to that of the test pumps heretofore available.

It is accordingly an outstanding object of the present invention to provide an improved lever operated piston and cylinder type pump for pumping fluid from a container to a fluid system to be tested under pressure for leaks.

Another object is the provision of a pump of the foregoing character having improved operating and performance characteristics.

Yet another object is the provision of a pump of the foregoing character which is operable to pump fluid under high pressure into a system being tested with less lever force than heretofore required.

Still a further object is the provision of a pump of the foregoing character which provides improved leverage with respect to displacement of the pump piston at high system pressures without sacrificing the full stroke fluid volume displacement capacity of the pump relative to pumps of comparable size heretofore available.

Another object is the provision of a pump of the foregoing character in which the pump cylinder and the lever are pivotally supported on the container and interconnected for pivotal displacement of the lever about its axis to reciprocate the pump piston in the cylinder and simultaneously pivot the cylinder about its pivot axis so as to provide a leverage for displacing the piston during the discharge stroke of the pump which progressively increases as the piston approaches the end of the discharge stroke.

Still a further object is the provision of a pump of the foregoing character wherein the pivotal interrelationship between the lever and the piston-cylinder unit minimizes the application of side thrust between the piston rod and cylinder and thus between the piston and cylinder during the discharge stroke, thus enhancing the ease with which the piston can be displaced by the lever to pump fluid under high pressure into a system being tested with an angular displacement of the lever larger than heretofore possible and, at the same time, with a lever force considerably less than heretofore required to displace the piston against the same system pressure and through a much smaller angular displacement.

Still another object is the provision of a pump of the foregoing character which is structurally simple and economical to construct, is efficient in operation and requires less physical exertion on the part of an operator with respect to raising the pressure in a system being tested to a given test pressure, and which can be operated at high test pressures without subjecting the operator to potential injury or the pump to potential damage as the result of instability of the pump.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
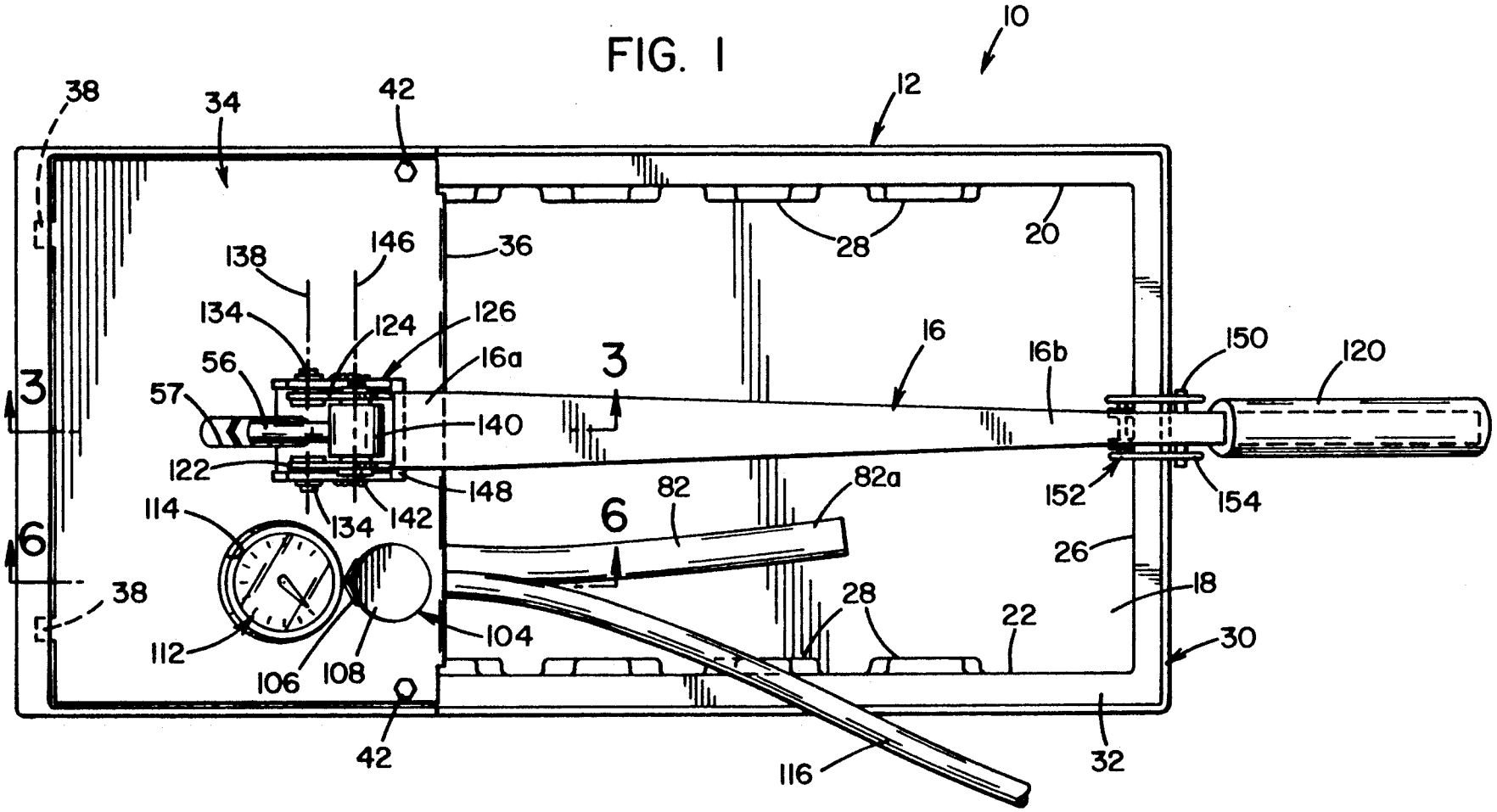
FIG. 1 is a plan view of a test pump in accordance with the present invention.

Referring now in greater detail to the drawings, wherein the showings are for the purpose of illustrating a preferred embodiment of the invention only, and not for the purpose of limiting the invention, a test pump 10 in accordance with the present invention includes a container 12 for fluid to be pumped into a system to be tested, a piston-cylinder type pump 14 for pumping liquid from the container into a system to be tested, and a hand lever 16 for operating pump 14 as described in greater detail hereinafter. Container 12 is preferably constructed of suitable plastic material and has a bottom wall 18, opposite side walls 20 and 22, and front and rear walls 24 and 26, respectively. Preferably, side walls 20 and 22 are provided with stiffening ribs 28, and the container has an upper edge defined by a peripherally continuous flange 30 which is configured to provide a ledge 32 extending outwardly of the corresponding one of the front, rear and side walls of the container. The portion of ledge 32 extending across front wall 24 and along a portion of side walls 20 and 22 extending rearwardly from the front wall supports a mounting plate 34 on which pump 14 and lever 16 are mounted as set forth more fully hereinafter. The inner end of support plate 34 is provided with a downwardly extending flange 36, and the support plate is mounted on container 12 by means of a pair of tabs 38 on the front end of the mounting plate which extend through slots 40 therefor in flange 30 and a pair of nut and bolt assemblies 42 extending through ledge 32 and plate 34 adjacent flange 36 thereof.

Figure 5:
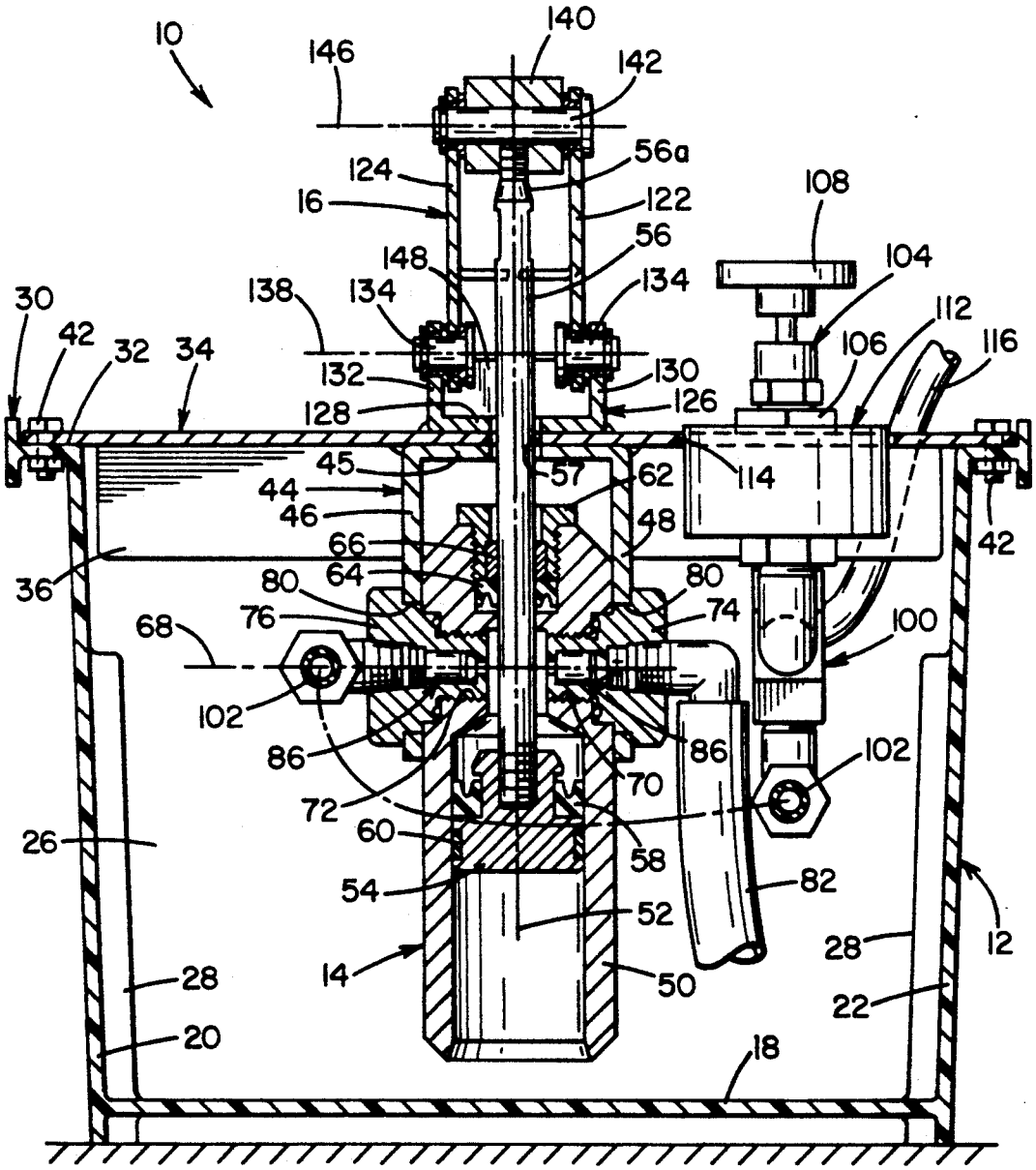
FIG. 5 is a cross-sectional elevation view taken along line 5—5 in FIG. 2.

As best shown in FIG. 5, pump 14 is mounted on the underside of support plate 34 by means of a U-shaped bracket 44 having a base 45 secured to plate 34 such as by welding and spaced apart mounting plates 46 and 48 extending downwardly from base 45. Pump 14 includes a cylinder 50 having an axis 52, and a coaxial piston 54 attached to the lower end of a coaxial piston rod 56 by which piston 54 is axially reciprocated in cylinder 50 as set forth more fully hereinafter. Piston 54 is provided with an annular seal 58 and an annular bronze guide ring 60, and piston rod 56 extends upwardly through a bushing 62 at the upper end of cylinder 50 and is guided and sealed relative to cylinder 50 by an annular rod seal 64 and bronze guide ring 66.

Figure 7:
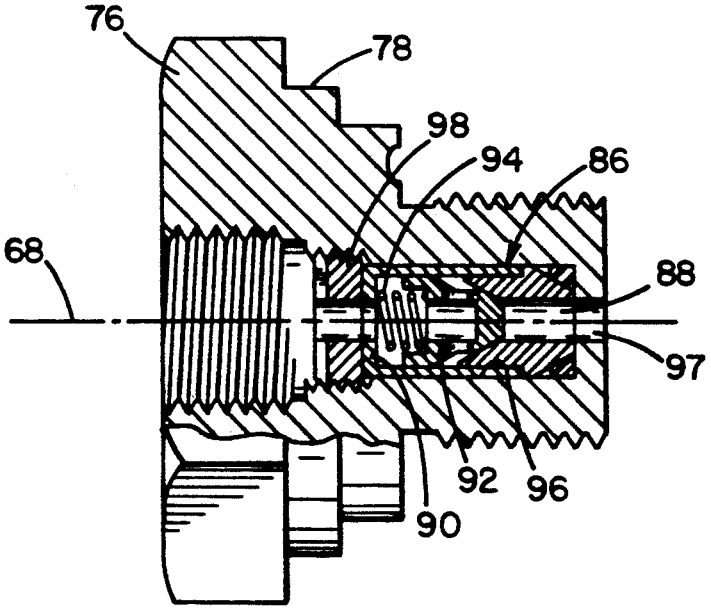

Cylinder 50 is received between mounting plates 46 and 48 of mounting bracket 44 and is supported thereon for pivotal displacement in opposite directions about a cylinder pivot axis 68 extending between side walls 20 and 22 of container 12 and transverse to cylinder axis 52. More particularly in this respect, cylinder 50 is provided with diametrically opposed passageways 70 and 72 coaxial with pivot axis 68 and opening to the interior of the cylinder and which passageways receive the threaded inner ends of a coupling member 74 and 76, respectively. As will be appreciated from FIG. 5 and, from FIG. 7 which shows coupling 76, couplings 74 and 76 have shoulders 78 received in an opening 80 in the corresponding one of the mounting plates 46 and 48 of mounting bracket 44, whereby cylinder 50 and thus pump 14 is pivotal relative to mounting bracket 44 and container 12 about cylinder pivot axis 68. If desired, a bearing sleeve, not shown, can be interposed between coupling shoulder 78 and opening 80.

Figure 3:
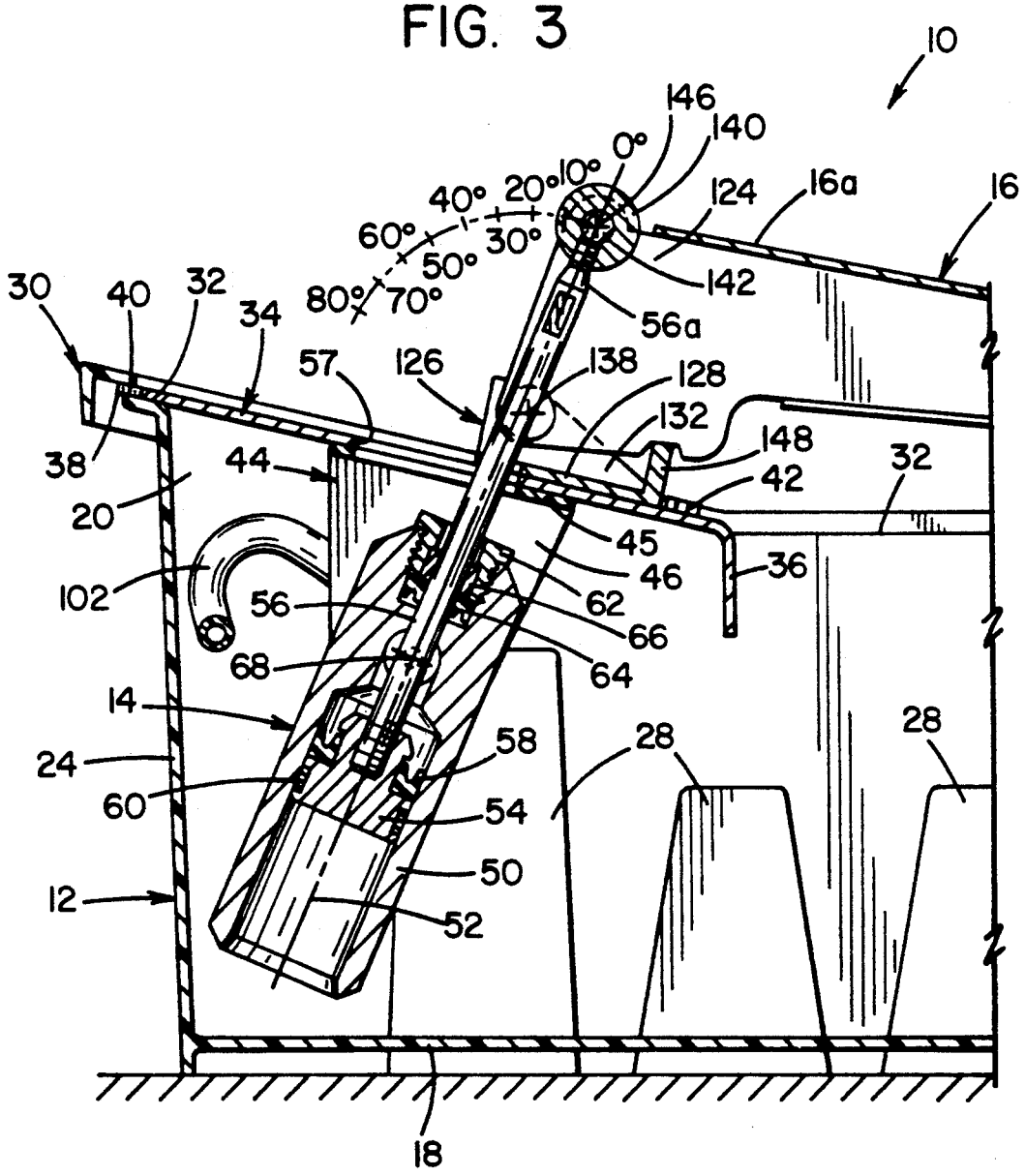
FIG. 3 is a sectional elevation view taken along line 3—3 in FIG. 1 showing the component parts of the pump in their relative positions at the end of the discharge stroke.
Figure 4:
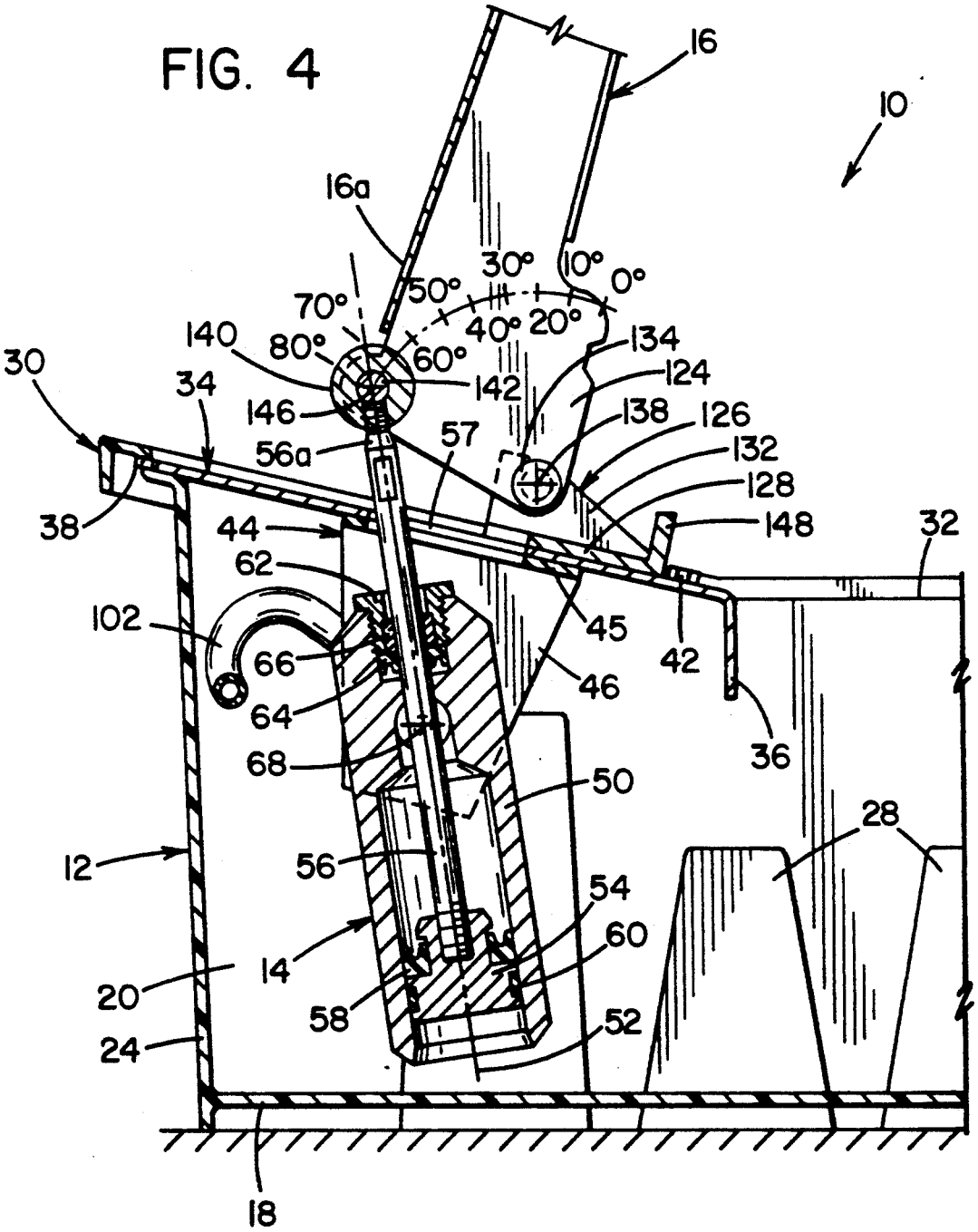
FIG. 4 is a sectional elevation view similar to FIG. 3 and showing the component parts of the pump in their relative positions at the end of the suction stroke.

Passageway 70 provides an inlet opening to cylinder 50, and coupling 74 is an inlet coupling by which the inlet side of pump 14 is connected in fluid flow communication with fluid F in container 12. For this purpose, a hose or the like 82 is connected to coupling 74 and has an inlet end **82*a* at the bottom of container 12. If desired, the inlet end of the house can be provided with a suitable filter, not shown. Similarly, passageway 72 provides an outlet opening from cylinder 50 and coupling 76 provides an outlet coupling by which fluid is discharged from the cylinder, as explained more fully hereinafter. As will be appreciated from FIG. 7, inlet and outlet couplings 74 and 76 are each provided with a replaceable, one-way valve cartridge 86 having an inlet end 88, a discharge end 90 and a slidable valve sleeve 92 biased by a spring 94 to close inlet end 88. Cartridge 86 is received in a chamber 96 in couplings 74 and 76, which chamber has an opening 97 at one end thereof, and the cartridge is removably retained in chamber 96 by an apertured threaded retaining plug 98 at the opposite end of the chamber. It will be appreciated, of course, that cartridge 86 is oriented in coupling 76 so as to permit fluid flow out of cylinder 50 and, accordingly is reversibly oriented in coupling 74 so as to permit fluid flow into cylinder 50. It will likewise be appreciated that displacement of piston 54 downwardly in cylinder 50 from the position thereof shown in FIGS. 3 and 5 to the position shown in FIG. 4 provides a suction stroke by which fluid is drawn into cylinder 50 from container 12 through inlet coupling 74, and that displacement of the piston upwardly in cylinder 50 from the position shown in FIG. 4 back to the position shown in FIGS. 3 and 5 provides a discharge stroke by which the fluid in cylinder 50 is displaced therefrom through outlet coupling 76**.

Figure 6:
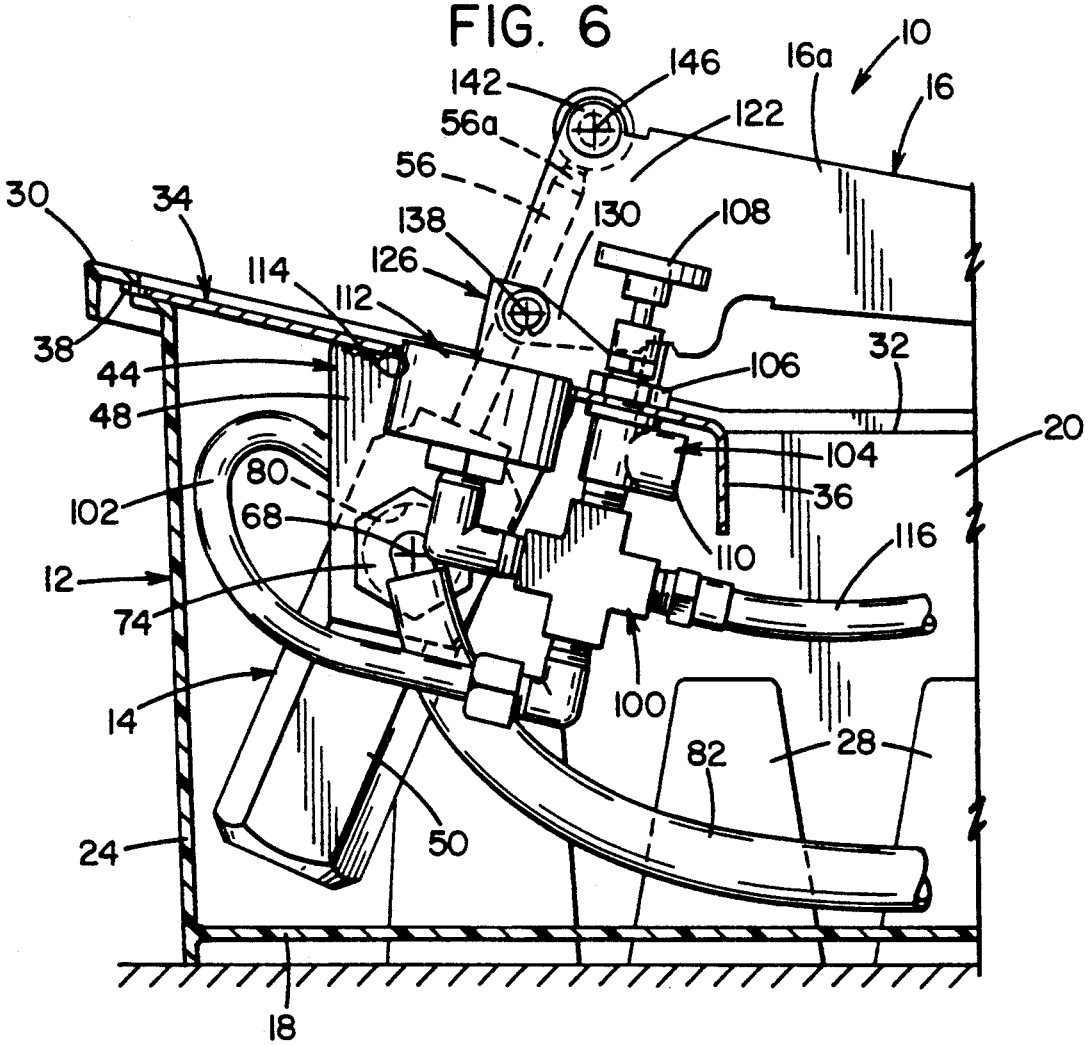
FIG. 6 is an elevation view, partially in section, taken along line 6—6 in FIG. 1 and showing the manifold arrangement for the discharge line, pressure gauge and dump valve; and, FIG. 7 is an enlarged detail view in section showing the flow control valve arrangement for the discharge side of the piston-cylinder pump.

As best seen in FIGS. 5 and 6, outlet coupling 76 is connected to the inlet side of a distribution manifold 100 by a flexible hose 102. Manifold 100 is supported beneath support plate 34 by means of a normally closed fluid return or dump valve 104 which is mounted on plate 34 by means of a nut 106 and which has an operating knob 108 for opening and closing a valve outlet 110 for the purpose set forth hereinafter. Manifold 100 supports a pressure gauge 112 in an opening 114 therefor in support plate 34, and a fluid discharge line 116 is connected to manifold 100 and has an outlet end, not shown, provided with a suitable coupling by which the discharge line is connected to a fluid system to be tested. During the discharge stroke of the pump piston, fluid flows through line 102 to manifold 100 and thence through discharge line 116 into the system being tested, and the fluid pressure in the system at any given time during the test is registered by pressure gauge 112. At the conclusion of a test, knob 108 of valve 104 is displaced to open the latter valve, whereby fluid pumped into the system is returned to container 12 through valve outlet 110.

Figure 2:
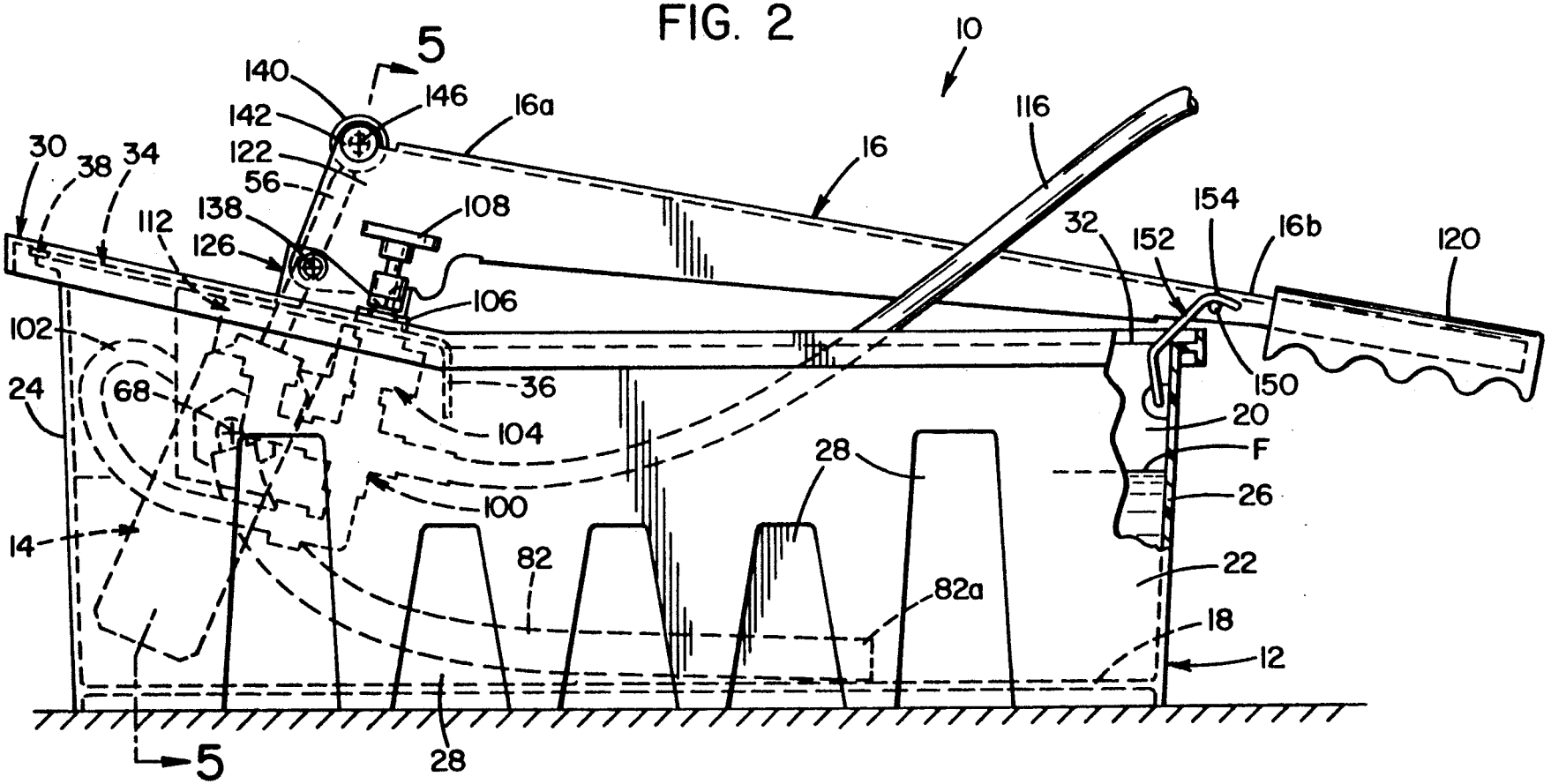
FIG. 2 is a side elevation view of the test pump.

Lever 16 is pivotally mounted on the upper side of support plate 34 and is pivotally interconnected with the upper end of piston rod 56 so as to displace piston 54 in opposite directions in cylinder 50 in response to pivotal displacement of the lever in opposite directions about its pivot axis. More particularly in this respect, lever 16 which is preferably of tubular, folded sheet metal construction has a front end **16*a* and a rear end 16*b* provided with a suitable hand grip 120. The folded sheet metal construction provides for front end 16*a* to have a pair of spaced apart parallel lever plates 122 and 124 by which the lever is pivotally mounted on support plate 34 and pivotally interconnected with piston rod 54. Lever 16 is pivotally mounted on support plate 34 by means of a U-shaped mounting bracket 126 having a base 128 secured to support plate 34 such as by welding and a pair of upwardly extending legs 130 and 132. The lower ends of lever plates 122 and 124 are respectively inwardly adjacent legs 130 and 132 and are pivotally secured thereto by corresponding pivot pins 134 which provide a lever pivot axis 138 spaced above and parallel to cylinder pivot axis 68. Piston rod 56 extends upwardly through a slot 57 provided therefor in support plate 34 and bases 45 and 128 of mounting brackets 44 and 126 and upper end 56*a* of the piston rod is threadedly interconnected with a sleeve 140, transverse to the sleeve axis. Sleeve 140 is received between the upper ends of lever plates 122 and 124 and is pivotally interconnected therewith by means of a pin 142. Pin 142 provides a piston rod pivot axis 146 which is parallel to cylinder pivot axis 68 and which is spaced above and parallel to lever pivot axis 138. Lever 16 is shown in FIGS. 2 and 3 in a first position which is the position of the lever at the end of the discharge stroke of the pump and, thus, at the beginning of the suction stroke. A stop plate 148, which can be integral with lever mounting bracket 126, is positioned to engage the lower edges of lever plates 122 and 124 to limit displacement of lever 16 in the direction of the discharge stroke of the pump. In FIG. 4, lever 16 is in its second position which is the position of the lever at the end of the suction stroke and, thus, at the beginning of the discharge stroke. As best seen in FIGS. 1 and 2, rear end 16*b* of lever 16 is provided with a cross pin 150, and rear wall 26 of container 12 is provided with a pivotal wire latch 152 having an upper end 154 adapted to engage over pin 150 when the lever is in the position shown in FIG. 2**. This latch arrangement facilitates using the lever as a handle for carrying the test pump.

In operation, container 12 is filled to a suitable level with system fluid to be pumped into a system to be tested and which system fluid can be water, hydraulic fluid, ethylene glycol, kerosene and other heating oils, and the like. The system is initially filled with system fluid, and the outlet end of discharge hose 116 is connected to a test port of the system. Lever 16 is then pivoted counterclockwise about lever axis 138 from the first lever position shown in FIGS. 2 and 3 to the position shown in FIG. 4 which, as will be appreciated from FIGS. 3 and 4, amounts to an angular displacement of lever 16 of about 80°. As will be appreciated from the positions of the component parts in FIGS. 3 and 4, this pivotal displacement of lever 16 displaces piston 54 downwardly in cylinder 50 and, simultaneously, pivots pump 14 counterclockwise about cylinder pivot axis 68. Downward displacement of piston 54 in cylinder 50 provides the intake or suction stroke for the pump whereby, during such displacement, fluid in container 12 is drawn into cylinder 50 through hose 82 and inlet coupling 74. Pivotal displacement of lever 16 clockwise about lever axis 138 from the second lever position shown in FIG. 4 to the first position shown in FIGS. 2 and 3 displaces piston 54 upwardly in cylinder 50 and, simultaneously, pivots pump 14 clockwise about cylinder pivot axis 68. Displacement of piston 54 upwardly in cylinder 50 from the position shown in FIG. 4 to the position shown in FIG. 3 provides the discharge stroke for the pump whereby, during such displacement, fluid in cylinder 50 is discharged through outlet coupling 76 and line 102 to manifold 100 and thence through line 116 into the system to which the test pump is coupled. The system pressure following the discharge stroke is registered by pressure gauge 112. As the test pressure is approached, the suction and discharge strokes are shortened by pivoting lever 16 through a smaller angular displacement from its first position than the full displacement of 80°. This assures that the discharge strokes at high pressures are achieved with an optimum application of force on the lever by the operator. Accordingly, it will be understood that reference hereinafter to a discharge stroke of the lever in degrees is with respect to the angular displacement of the lever from its first position at the beginning of the discharge stroke.

It is to be noted at this point that the pivotal mounting and pivotal interrelationship between pump 14 and lever 16 provides for a variable volume of flow during the discharge stroke of the pump and a variable leverage for displacement of the pump piston during the discharge stroke and which leverage progressively increases as the lever and thus the pump piston approach the end of the discharge stroke. More particularly in this respect, as will be appreciated from the positions of the component parts shown in FIG. 3, when lever 16 is in its first position at the beginning of the suction stroke and at the end of the discharge stroke piston rod pivot axis 146, cylinder pivot axis 68 and lever pivot axis 138 are substantially coplanar, whereby a downward force on end **16*b* of lever 16 translates into a substantially axial force upwardly on piston rod 56 and thus piston 54 in the direction of the discharge stroke. As lever 16 is pivoted counterclockwise about lever axis 138 to the position shown in FIG. 4, and thus through the suction stroke for the pump, piston rod pivot axis 146 pivots counterclockwise about cylinder pivot axis 68 and progressively away from lever axis 138. During this movement of the lever, piston 54 is displaced downwardly in cylinder 50 and, as will be appreciated from the lever arm defined by axes 138 and 146, the rate of downward displacement of piston 54 progressively increases, whereby the volume of fluid flow into cylinder 50 progressively increases during the suction stroke. When the component parts reach the position thereof shown in FIG. 4, which are the positions of the component parts at the end of the suction stroke and the beginning of the discharge stroke, the lever arm defined by axes 138 and 146 provides the least amount of leverage with respect to displacing piston 54 during the ensuing discharge stroke. When lever 16 is pivoted clockwise from the position shown in FIG. 4, the component parts move through the discharge stroke from the positions shown in FIG. 4 back towards the positions thereof shown in FIG. 3 and, during the discharge stroke, rod pivot axis 146 pivots clockwise about cylinder axis 68 and progressively back toward the substantially coplanar relationship with axes 68 and 138 shown in FIG. 3. It will be appreciated, therefore, that the leverage for displacing the pump piston progressively increases during the discharge stroke and is optimized when the component parts again reach the positions shown in FIG. 3. Also during the discharge stroke, the rate of displacement of piston 54 upwardly in cylinder 50 progressively decreases, whereby the volume of fluid flow progressively decreases during the discharge stroke. Accordingly, with respect to a full stroke displacement of lever 16 and piston 54 during the discharge stroke, the discharge stroke begins with a high volume displacement of fluid from cylinder 50 and a moderate leverage for displacing the piston and ends with a low volume fluid displacement and optimum leverage with respect to displacing the piston. It is to be noted at this point with respect to the substantially coplanar relationship referred to herein with respect to axes 68, 138 and 146 in the first position of lever 16, that lever axis 138 is intentionally offset slightly rearwardly of the plane through axes 68 and 146 when lever 16 engages stop 148 to preclude the piston rod from moving to an over center position relative to axis 138 which would cause piston 54 to suck fluid into cylinder 50** and the end of the discharge stroke and thus discharge fluid at the beginning of the ensuing suction stroke. Therefore, the term substantially coplanar reflects such an offset. At the same time, it will be appreciated that the axes could be coplanar in the first position of the handle, it simply being preferred to assure against the undesired suction at the end of the discharge stroke. Therefore, the term substantially coplanar as used herein is intended to include a planar relationship between the three axes.

In connection with testing a system, the pump according to the present invention advantageously enables the initial pumping of additional fluid into the system quickly and with a minimum number of full strokes of lever 16 and, as the test pressure is approached, enables the fluid to be pumped into the system with considerably less force on lever 16 than heretofore required and, thus, with considerably less physical effort on the part of the operator. The foregoing advantages are best appreciated with reference to a comparison between the pump according to the preferred embodiment illustrated and described herein and a pump of comparable dimensions and of the structure of previously available pumps in which the pump cylinder is fixed relative to the container and the piston rod is pivotally connected to the lever at a location between the pivot axis for the lever and the opposite or operating end of the lever. In a pump of the latter structure having a lever length of about 63.3 centimeters or 24.92 inches, a piston diameter of about 2.98 centimeters or 1.18 inches, and a pivotal connection between the piston rod and lever at a distance of about 7.42 centimeters or 2.92 inches in the direction from the lever pivot axis towards the opposite end of the lever, displacement of the lever through a discharge stroke of just 20° requires a force on the operating end of the lever of more than 130 pounds when the system test pressure is 50 bar or 725 psi. At the same test pressure, a force of more than 125 pounds on the lever is required to displace the piston through a discharge stroke of about 10°. In contrast, a pump according to the preferred embodiment having a lever length from lever axis 138 to the opposite end of the lever of about 54.38 centimeters or 21.41 inches, a lever arm length between axes 138 and 146 of about 6 centimeters or 2.36 inches and a piston diameter of about 3.48 centimeters or 1.37 inches is adapted to pump fluid at a system pressure of 50 bar or 725 psi through a discharge stroke of 20° with a force on the operating end of the lever of less than 40 pounds, and is adapted to pump fluid at the same system pressure through a discharge stroke of 10° with a lever force of about 30 pounds. Furthermore, the pump according to the present invention is adapted to pump fluid at the foregoing test pressure through a discharge stroke of the lever between about 55° to 60° with a lever force of between 85 and 90 pounds, through a discharge stroke of the lever of about 40° with a lever force of between 65 to 70 pounds, and through a lever discharge stroke of about 30° with a handle force of between about 55 to 60 pounds. These figures indicate that, at a given system pressure, the leverage for displacing the piston in the direction of the discharge stroke of the pump increases as the piston approaches the end of the discharge stroke. Still further, the pump of the preferred embodiment has a per stroke fluid displacement capacity comparable to that of the prior art pump, and the prior art pump cannot be operated at a test pressure of 50 bar or 725 psi with a lever discharge stroke of 30° or more. Moreover, it will be clearly appreciated from the foregoing figures that the pump of the present invention can be operated, without excessive physical exertion by the operator, to deliver fluid under pressure into a system being tested at pressures in excess of 50 bar or 725 psi.

While considerable emphasis has been placed herein on the structures of and the structural interrelationships between the component parts of the preferred embodiment, it will be appreciated that other embodiments of the invention can be made and that many changes can be made in the preferred embodiment without departing from the principals of the present invention. In particular, it will be appreciated that the fluid inlet and outlet flow paths for the cylinder do not have to be coaxial with the pivotal mounting thereof. Further, any suitable one-way valve, such as a spring biased check valve, can be used to control the flow of fluid into and from the cylinder, and the one-way valves could be provided in the inlet and outlet lines at locations other than those shown in the preferred embodiment. Still further, it will be appreciated that the dimensions referred to hereinabove with regard to the preferred embodiment, and the preferred substantially coplanar relationship between the cylinder, piston rod and lever axes, can be varied without affecting the structural interrelationship between the component parts which provides for the variable displacement and variable leverage features by which the improved operating and performance characteristics are attained in accordance with the present invention. Moreover, while hand lever operation is preferred, it will be appreciated that the lever could be foot operated, in which case a biasing spring would be provided to bias the lever from the first toward the second position thereof. The foregoing and other modifications of the preferred embodiment as well as other embodiments of the invention will be obvious or suggested to those skilled in the art from the disclosure herein, whereby it is to be distinctly understood that the foregoing descriptive matter is to be interpreted merely as illustrative of the present invention and not as a limitation.

I claim:

1. A pump for pressure testing a fluid system comprising container means for fluid to be pumped into said system, cylinder means having a cylinder axis and supported on said container means for pivotal displacement about a cylinder pivot axis transverse to said cylinder axis, said cylinder means having inlet means to flow communication with fluid in said container means and outlet means for delivering fluid to said system, piston means reciprocable in said cylinder means, lever means supported on said container means for pivotal displacement about a lever axis, said piston means including piston rod means connected to said lever means at a rod pivot axis, pivotal displacement of said lever means in opposite directions about said lever axis displacing said piston means in opposite directions in said cylinder means through suction and discharge strokes and simultaneously pivotally displacing said cylinder means in opposite directions about said cylinder pivot axis for progressively increasing the leverage with respect to displacement of said piston means during said discharge stroke, and valve means for controlling the flow of fluid through said inlet means and outlet means of said cylinder means in response to displacement of said piston means in opposite directions in said cylinder means.

2. The pump according to claim 1, wherein said lever means has first and second positions, displacement of said lever means from said first toward said second position displacing said piston means through said suction stroke to cause fluid in said container means to flow into said cylinder means, displacement of said lever means from said second toward said first position displacing said piston means through said discharge stroke to cause fluid to flow from said cylinder means.

3. The pump according to claim 2, wherein said cylinder pivot axis, said lever axis and said rod pivot axis are in generally coplanar relationship in said first position of said lever means, said rod pivot axis pivots about said cylinder pivot axis and away from said lever axis during displacement of said lever means from said first to said second position, and displacement of said lever means from said second toward said first position displaces said rod pivot axis back toward said coplanar relationship, whereby the leverage for displacing said piston means progressively increases during said discharge stroke.

4. The pump according to claim 3, wherein said lever axis is between said rod pivot axis and said cylinder pivot axis.

5. The pump according to claim 1, wherein said cylinder pivot axis and said lever axis are fixed relative to said container means and said rod pivot axis pivots in opposite directions about said cylinder pivot axis during pivotal displacement of said lever means in opposite directions about said lever axis.

6. The pump according to claim 1, wherein said inlet means and said outlet means of said cylinder means are coaxial with said cylinder pivot axis.

7. The pump according to claim 1, wherein said container mean has upper edge means, support plate means on said upper edge means and having outer and inner sides with respect to said container means, said lever means being pivotally mounted on said outer side of said support plate means, said cylinder means being pivotally mounted on said inner side of said support plate means, said piston rod means extending from said cylinder means through an opening in said support plate means and having an end pivotally connected to said lever means at said rod pivot axis.

8. The pump according to claim 7, wherein said rod pivot axis is spaced outwardly from said lever axis.

9. The pump according to claim 7, wherein said support plate means is removably mounted on said container means.

10. The pump according to claim 7, wherein said lever means is pivotal about said lever axis between first and second positions, displacement of said lever means from said first toward said second position displacing said piston means through said suction stroke to cause fluid to flow into said cylinder means, and displacement of said lever means from said second toward said first position displacing said piston means through said discharge stroke to cause fluid to flow from said cylinder means.

11. The pump according to claim 10, wherein said cylinder pivot axis, said lever axis and said rod pivot axis are in generally coplanar relationship in said first position of said lever means, said rod pivot axis pivots about said cylinder pivot axis and away from said lever axis during displacement of said lever means from said first to said second position, and displacement of said lever means from said second toward said first position displaces said rod pivot axis back toward said coplanar relationship, whereby the leverage for displacing said piston means progressively increases during said discharge stroke.

12. The pump according to claim 11, wherein said rod pivot axis is spaced outwardly from said lever axis.

13. The pump according to claim 12, wherein said inlet and outlet means are coaxial with said cylinder axis.

14. The pump according to claim 13, wherein said support plate means is removably mounted on said container means.

15. A pump for pressure testing a fluid system comprising, container means for fluid to be pumped into said system, said container means having opposite sides and opposite ends and upper edge means, support plate means on said upper edge means between said opposite sides at one of said opposite ends, said support plate means having outer and inner sides with respect to said container means, cylinder means having an axis, means mounting said cylinder means on said inner side of said support plate means for pivotal movement about a cylinder pivot axis extending in the direction between said opposite sides of said container means and transverse to said cylinder axis, said cylinder means including fluid inlet means in flow communication with fluid in said container means and fluid outlet means for delivering fluid to said system, piston means including piston rod means coaxial with said cylinder axis and reciprocable in said cylinder means, said piston rod means extending from said cylinder means and having an outer end spaced from said outer side of said support plate means, lever means having first and second ends, means mounting said first end on said outer side of said support plate means for pivotal movement of said lever means about a lever axis parallel to said cylinder pivot axis, said outer end of said piston rod means being pivotally connected to said first end of said lever means at a rod pivot axis parallel to said lever axis and spaced outwardly therefrom, whereby pivotal movement of said lever means in opposite directions about said lever axis displaces said piston means in opposite directions in said cylinder means through suction and discharge strokes and pivots said cylinder means in opposite directions about said cylinder pivot axis for progressively increasing the leverage with respect to displacement of said piston means during said discharge stroke, and valve means responsive to displacement of said piston means in said opposite directions thereof to cause fluid to flow into and from said cylinder means.

16. The pump according to claim 15, wherein said fluid inlet and outlet means for said cylinder means include inlet and outlet passageway means coaxial with said cylinder pivot axis.

17. The pump according to claim 16, wherein said valve means includes one way valve means coaxial with each said inlet and outlet passageway means.

18. The pump according to claim 15, wherein said support plate means is removably mounted on said container means.

19. The pump according to claim 15, wherein said lever means has first and second positions, displacement of said lever means from said first to said second position providing said suction stroke during which said piston means is displaced to cause fluid in said container means to flow into said cylinder means through said inlet means, and displacement of said lever means from said second to said first position providing said discharge stroke during which said piston means is displaced to cause fluid in said cylinder means to flow through said outlet means.

20. The pump according to claim 19, wherein said cylinder pivot axis, said lever axis and said rod pivot axis are in generally coplanar relationship when said lever means is in said first position and said rod pivot axis pivots about said cylinder pivot axis and away from said lever axis during said suction stroke and back toward said coplanar relationship during said discharge stroke, whereby the leverage for displacing said piston means during said discharge stroke progressively increases as said lever means is displaced from said second position toward said first position thereof.

21. The pump according to claim 20, wherein said means mounting said cylinder means on said inner side of said support plate means includes a pair of mounting plates spaced apart and transverse to said cylinder pivot axis, said cylinder means being between said mounting plates, said fluid inlet and outlet means including inlet and outlet openings in said cylinder means coaxial with said cylinder pivot axis, said means mounting said cylinder means further including inlet and outlet coupling means extending through opening means in said mounting plates and respectively into said inlet and outlet openings in said cylinder means, said coupling means being pivotal in said opening means in said mounting plates and supporting said cylinder means for pivotal displacement about said cylinder pivot axis, and inlet and outlet line means respectively connected to said inlet and outlet coupling means.

22. The pump according to claim 21, wherein said support plate means is removably mounted on said container means.

23. The pump according to claim 15, wherein said means mounting said cylinder means on said inner side of said support plate means includes a pair of mounting plates spaced apart and transverse to said cylinder pivot axis, said cylinder means being between said mounting plates, said fluid inlet and outlet means including inlet and outlet openings in said cylinder means coaxial with said cylinder pivot axis, said means mounting said cylinder means further including inlet and outlet coupling means extending through opening means therefor in said mounting plates and respectively into said inlet and outlet openings in said cylinder means, said coupling means being pivotal in said opening means in said mounting plates and supporting said cylinder means for pivotal displacement about said cylinder pivot axis, and inlet and outlet line means respectively connected to said inlet and outlet coupling means.

24. The pump according to claim 23, wherein said lever means has first and second positions, displacement of said lever means from said first to said second position providing said suction stroke during which said piston means is displaced to cause fluid in said container means to flow into said cylinder means through said inlet means, and displacement of said lever means from said second to said first position providing said discharge stroke during which said piston means is displaced to cause fluid in said cylinder means to flow through said outlet means.

25. The pump according to claim 24, wherein said cylinder pivot axis, said lever axis and said rod pivot axis are in generally coplanar relationship when said lever means is in said first position and said rod pivot axis pivots about said cylinder pivot axis and away from said lever axis during said suction stroke and back toward said coplanar relationship during said discharge stroke, whereby the leverage for displacing said piston means during said discharge stroke progressively increases as said lever means is displaced from said second position toward said first position thereof.

26. The pump according to claim 23, wherein said valve means includes one-way valve means in each said inlet and outlet coupling means.

27. The pump according to claim 26, wherein said support plate means is removably mounted on said container means.

28. A pump for pressure testing a fluid system comprising container means for fluid to be pumped into said system, cylinder means having inlet means in flow communication with fluid in said container means and outlet means for delivering fluid to said system, piston means in said cylinder means, said piston means and cylinder means being relatively reciprocable through suction and discharge strokes, valve means for controlling the flow of fluid through said inlet means and outlet means of said cylinder means in response to relative displacement of said piston means and cylinder means through said suction and discharge strokes, lever means for relatively displacing said piston means and cylinder means through said suction and discharge strokes, said lever means being supported on said container means for pivotal displacement in opposite directions about a lever axis, and means interconnecting said lever means said piston means and said cylinder means for displacement of said lever means in one of said opposite directions to relatively displace said piston means and said cylinder means through said discharge stroke with a progressively decreasing volume of flow through said outlet means and progressively increasing leverage with respect to said relative displacement of said piston means and cylinder means.

29. A pump for pressure testing a fluid system comprising container means for fluid to be pumped into said system, cylinder means having inlet means in flow communication with fluid in said container means and outlet means for delivering fluid to said system, piston means reciprocable in said cylinder means and including piston rod means, lever means supported on said container means for pivotal displacement about a lever axis, one of said piston rod means and said cylinder means being connected to said container means at a first pivot axis, the other of said piston rod means and said cylinder means being connected to said lever means at a second pivot axis, whereby pivotal displacement of said lever means in opposite directions about said lever axis relatively reciprocates said piston means and said cylinder means in opposite directions through suction and discharge strokes and simultaneously pivotally displaces said piston rod means and said cylinder means in opposite directions about said first pivotal axis for progressively increasing the leverage with respect to displacement of said piston means during said discharge stroke, and valve means for controlling the flow of fluid through said inlet means and outlet means of said cylinder means in response to said relative reciprocation between said piston means and said cylinder means.

* * * * *

UNITED STATES PATENT AND TRADEMARK OFFICE

CERTIFICATE OF CORRECTION

PATENT NO. : 5,221,195

DATED : June 22, 1993

INVENTOR(S) : Valere H. J. Beelen

It is certified that error appears in the above-identified patent and that said Letters Patent is hereby corrected as shown below:

Column 2, line 10, after "operator" introduce --- . ---; line 21, change "increase" to --- increases ---. Column 14, line 54, change "pivotal" to --pivot--.

Signed and Sealed this

First Day of February, 1994

*Attest:*

*Attesting Officer*

BRUCE LEHMAN

*Commissioner of Patents and Trademarks*